US008708675B2

(12) United States Patent
Martinez et al.

(10) Patent No.: US 8,708,675 B2
(45) Date of Patent: Apr. 29, 2014

(54) SYSTEMS AND METHODS OF USING SUBSEA FRAMES AS A HEAT EXCHANGER IN SUBSEA BOOSTING SYSTEMS

(75) Inventors: Ignacio Martinez, Rio de Janeiro (BR); Donn J. Brown, Broken Arrow, OK (US); John J. Mack, Catoosa, OK (US); Steven K. Tetzlaff, Owasso, OK (US); Dan A. Merrill, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 412 days.

(21) Appl. No.: 13/163,395

(22) Filed: Jun. 17, 2011

(65) Prior Publication Data

US 2011/0247788 A1 Oct. 13, 2011

Related U.S. Application Data

(63) Continuation-in-part of application No. 12/825,141, filed on Jun. 28, 2010.

(60) Provisional application No. 61/221,451, filed on Jun. 29, 2009.

(51) Int. Cl.
*F04D 13/08* (2006.01)

(52) U.S. Cl.
USPC ..... 417/423.8; 417/423.3; 417/368; 417/53; 310/54

(58) Field of Classification Search
CPC ..... F28D 1/022; F28D 2021/0049; F04D 13/0653; F04D 13/08; F04D 13/086; H02K 5/132; H02K 9/19
USPC ..... 417/367, 368, 370, 423.1, 424.1; 166/67, 68, 105, 64.4, 302, 357, 359, 166/368; 175/107; 310/54, 64, 87, 89, 52
See application file for complete search history.

(56) References Cited

U.S. PATENT DOCUMENTS 2,556,435 A 6/1951 Moehrl et al.
3,242,360 A 3/1966 Carle (Continued)

FOREIGN PATENT DOCUMENTS

EP 0 566 646 B1 6/2000
EP 0 986 692 B1 1/2006

(Continued)

OTHER PUBLICATIONS

One sheet from a brochure of Byron Jackson identified as Bulletin No. 2560-6A, brochure published in the 1990's (unknown specific date).

*Primary Examiner* — Devon Kramer
*Assistant Examiner* — Joseph Herrmann
(74) *Attorney, Agent, or Firm* — Bracewell & Giuliani LLP

(57) ABSTRACT

Systems and methods of cooling a motor of an electrical submersible pump (ESP) assembly employed in an electrical submersible subsea booster pumping system, are provided. A supporting frame structure such as an ESP mounting skid or top end assembly of a caisson having structural members exposed to environmental seawater, is modified or designed to include fluid conduits within the structural members to establish lubricant pathways for lubricant to flow. A heated/hot lubricant line connects between a supporting structure lubricant inlet port and an ESP motor lubricant outlet port. A cooled lubricant line connects between a supporting structure lubricant outlet port and an ESP motor lubricant inlet port. A pump or other fluid moving device circulates lubricant from the ESP motor to the lubricant pathways within the supporting frame structure, whereby the seawater cools the lubricant contained therein, which is then circulated back into the motor to assisting cooling the motor.

20 Claims, 5 Drawing Sheets

(56) References Cited

U.S. PATENT DOCUMENTS

| | | | | |
|---|---|---|---|---|
| 3,671,786 | A | 6/1972 | Jones | |
| 4,286,185 | A | 8/1981 | Erickson | |
| 4,685,867 | A | 8/1987 | Patun et al. | |
| 5,203,682 | A * | 4/1993 | Inklebarger | 417/435 |
| 7,492,069 | B2 | 2/2009 | Knox et al. | |
| 7,516,795 | B2 * | 4/2009 | Lopes Euphemio et al. | 166/357 |
| 8,037,936 | B2 | 10/2011 | Neuroth et al. | |
| 8,382,457 | B2 * | 2/2013 | Wilson et al. | 417/423.3 |
| 2009/0232664 | A1 * | 9/2009 | Qu et al. | 417/44.1 |
| 2009/0269224 | A1 | 10/2009 | Hunt et al. | |
| 2010/0026109 | A1 | 2/2010 | Hassett et al. | |
| 2010/0129237 | A1 | 5/2010 | Eide et al. | |
| 2010/0300751 | A1 | 12/2010 | Tao et al. | |
| 2010/0329908 | A1 | 12/2010 | Martinez | |

FOREIGN PATENT DOCUMENTS

| | | |
|---|---|---|
| JP | 56-162295 | 12/1981 |
| WO | 2009137317 A1 | 11/2009 |
| WO | 2010085204 A1 | 7/2010 |

* cited by examiner

SYSTEMS AND METHODS OF USING SUBSEA FRAMES AS A HEAT EXCHANGER IN SUBSEA BOOSTING SYSTEMS

RELATED APPLICATIONS

This application claims priority to and benefit of U.S. patent application Ser. No. 12/825,141 filed Jun. 28, 2010, titled "Heat Exchanger for ESP Motor," which claims priority to provisional Patent Application No. 61/221,451, filed Jun. 29, 2009, each incorporated by reference in its entirety.

BACKGROUND OF THE INVENTION

1. Field of the Invention

This invention relates in general to electrical submersible subsea booster pumping systems, and in particular to reducing the temperature of a subsea submersible electric pump motor through heat exchange with a frame structure having a non-heat exchange related primary function.

2. Description of the Related Art

Electrical submersible pumps ("ESP") are used for pumping high volumes of well fluid, particularly in wells requiring artificial lift. The ESP typically has at least one electrical motor that normally is a three-phase, AC motor. The motor drives a centrifugal pump that may contain a plurality of stages, with each stage comprising an impeller and a diffuser that increases the pressure of the well fluid. The motor has a housing that is filled with a dielectric lubricant or oil that both provides lubrication and aids in the removal of heat from the motor during operation of the ESP. A seal section is typically located between the pump and the motor for equalizing the pressure of the lubricant contained within the motor with the hydrostatic pressure of the well fluid on the exterior.

The ESP is typically run within the well with a workover rig. The ESP is run on the lower end of a string of production tubing. Once in place, the ESP may be energized to begin producing well fluid that is discharged into the production string for pumping to the surface.

During operation, the temperature of the oil in the motor of the ESP increases due to mechanical friction and electrical inefficiencies. According to most conventional designs, internal motor heat is dissipated by passing the produced (pumped) fluid over an outer surface of the motor housing which is in heat conductive contact with the stator of the motor. As such, a higher fluid velocity of the produced fluid around the motor, or a lower fluid temperature, can lead to increased heat removal from the motor.

One of the most important properties of the motor oil is to lubricate the bearings and thrust bearing of the motor. The oil is also generally vital in dissipating heat from the bearings and thrust bearings in order to help maintain the motor within its rated temperature, and thus maintain motor reliability. Rejection of heat from the oil to the surrounding well fluid, however, is usually limited due to the well fluid's high temperature, and also its poor heat transfer characteristics due to its high viscosity.

An increased temperature of the motor oil due to failure to adequately dissipate heat may lead to low performance or premature failure of the motor. U.S. Patent Publication No. 2010/0329908 by Martinez et al., titled "Heat Exchanger for ESP Motor," commonly assigned to the same assignee, describes an advancement in motor cooling technology which describes an externally mounted heat exchanger to serve ESP equipment installed on the seabed. A hot oil line connects the base of the ESP motor with the externally located heat exchanger, allowing hot motor oil to be circulated through coils in a heat exchanger which are externally exposed to seawater. The heat from the oil is rejected to the seawater and the cooled oil is reintroduced to the motor via a cooled oil line that communicates with the seal section. The heat exchanger arrangement reduces the temperature of an ESP motor, thus allowing the motor to operate longer and more reliably.

Recognized by the inventors, however, is that it would be beneficial as to both capital cost and heat exchange efficiency to utilize existing structures adjacent ESP motor exposed to relatively cold seawater to perform the function of an external heat exchanger—i.e., to provide improved motor cooling by circulating oil or lubricant out of the motor to cool down the motor temperature, to thereby allow the motor to operate at a lower temperature that may translate to an extended life and increased reliability of the motor, without the need for a separate dedicated heat exchanger or the associated space/real estate taken by such separate dedicated heat exchanger.

SUMMARY OF THE INVENTION

In view of the foregoing, various embodiments of the present invention advantageously provide systems and methods for cooling a motor of an electrical submersible pump (ESP) assembly employed in an electrical submersible subsea booster pumping system by cooling the motor lubricant that does not require the addition of an independent external heat exchange unit. Rather advantageously, various embodiments of the present invention utilize a subsea supporting frame structures having a different or unrelated primary function, such as, for example, an ESP mounting skid or top end assembly of a caisson, modified to also function as a surrogate external heat exchanger to cool oil circulating through a motor of an ESP.

More specifically, an example of an embodiment of a system for cooling a motor of an ESP assembly employed in an electrical submersible subsea booster pumping system, can comprise an ESP assembly including a subsea ESP having one or more pump stages, a motor, and a seal section located between the one or more pump stages and the motor. The motor housing can include a dielectric lubricant outlet port extending through a first portion of the housing and a dielectric lubricant inlet port extending through a second portion of the housing. A containment vessel or capsule is positioned about at least major portions of the ESP assembly to contain the ESP.

The system can also include a subsea supporting frame structure in the form of a modified ESP mounting skid or top-end assembly of a caisson. Each of a plurality of elongate main structural members of the supporting frame structure have or have been modified or otherwise configured to have a main body containing a fluid conduit formed at least partially, but more typically completely therethrough along a longitudinal axis thereof. Each fluid conduit is positioned in fluid communication with at least one other of a plurality of fluid conduits corresponding to the plurality of elongate main structural members to form a closed fluid circuit. At least one of the plurality of elongate main structural members include a fluid inlet port in fluid communication with the dielectric lubricant outlet port in the containment vessel of the ESP assembly via a hot or heated lubricating fluid conduit or line either extending therethrough or connected thereto. At least one of the plurality of elongate main structural members also include a fluid outlet port in fluid communication with the dielectric lubricant inlet port in the containment vessel of the ESP assembly via a cold or cooled lubricating fluid conduit or line either extending therethrough or connected thereto.

As a result of interconnection of the main structural members, and particularly their fluid conduits, the supporting frame includes a plurality of different dielectric lubricant pathways (similar in form to that of a manifold) extending between the fluid inlet and the fluid outlet of the supporting frame structure and through a corresponding different set of one or more of the plurality of fluid conduits defining the pathways. The plurality of different dielectric lubricant pathways provided by the supporting frame structure, in conjunction with the relatively large exterior surface area and relatively high thermal conductivity of the main structural members, facilitates a transfer of heat energy in the dielectric lubricant circulating through the plurality of different dielectric lubricant pathways to the surrounding seawater. That is, heat energy is readily transferred to seawater flowing through the subsea supporting frame structure and across exterior surfaces of the elongate main structural members when the supporting frame structure and ESP assembly are operationally deployed, to thereby reduce temperature of the dielectric lubricant, and thus, the temperature of the motor.

The system also includes at least one fluid conduit or line extending between the motor housing dielectric lubricant outlet port and the supporting frame structure fluid inlet to thereby form a heated dielectric lubricant discharge pathway therebetween. The system further includes at least one fluid conduit extending between the supporting frame structure fluid outlet and the motor housing dielectric lubricant inlet port to thereby form a cooled dielectric lubricant return pathway therebetween. A fluid moving device is positioned to circulate the dielectric lubricant for the motor through the heated dielectric lubricant discharge pathway, through the plurality of different dielectric lubricant pathways provided by the supporting frame structure, and through the cooled dielectric lubricant return pathway, to be cooled by the seawater flowing past and through the structural members of the supporting frame structure.

Advantageously, a total quantity of the dielectric lubricant circulated within the fluid conduits in the elongate main structural members of the supporting frame structure in the form of either an ESP mounting skid or a top-end assembly of a caisson (forming a surrogate heat exchanger) exceed a dielectric lubricant capacity of the dielectric lubricant circulation components contained within the confines of the motor housing, alone, by at least a factor of at least three or four, but more typically by a factor of between about five to ten, to thereby enhance cooling of the motor.

As noted above, various embodiments of the present invention also include methods of cooling a motor of an ESP assembly employed in an electrical submersible subsea booster pumping system. An example of an embodiment of such a method, the method can include the steps of providing a ESP assembly in a vicinity of a sea floor comprising an ESP having a motor and at least one pump housed within a containment vessel, and employing or otherwise providing a subsea supporting frame structure comprising either a mounting skid configured to frame at least major portions of the ESP assembly or a top end assembly of a subsea caisson, as a surrogate heat exchanger. Examples of configurations of the ESP and subsea supporting frame structure configured to provide a closed fluid circuit for cooling motor lubricant were described previously.

The steps can also include circulating dielectric lubricant from a dielectric lubricant outlet port of the motor housing to a fluid inlet of the supporting frame structure, removing heat from the dielectric lubricant circulating through the plurality of elongate main structural members flowing through a plurality of different pathways between the fluid inlet and a fluid outlet of the supporting frame structure, and circulating the dielectric lubricant from the outlet port of the supporting frame structure to the dielectric lubricant inlet port of the motor housing.

Advantageously, the heat removal process can be accomplished by transferring heat energy in the dielectric lubricant to seawater naturally flowing through the subsea supporting frame structure and across exterior surfaces of its elongate main structural members to thereby reduce the temperature of the dielectric lubricant. When introduced back into the confines of the housing of the motor, the cooled dielectric lubricant then functions to cool internal motor components more effectively. Thus, the life of the motor is advantageously extended and its reliability is advantageously increased.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

Electrical submersible pumps (ESPs) have been used for subsea boosting on the seabed. The ESPs are typically deployed/employed by placing the ESP inside a caisson generally located substantially below the mud line of the seafloor, or by placing the ESP inside a capsule located on a mounting skid having a frame structure. The housing of the ESP motor is generally full of a dielectric oil or other lubricant. FIGS. 1-8 illustrate various embodiments of a system 30, 30' and methods for cooling the motor of an ESP/pump assembly employed in an electrical submersible subsea booster pumping system, by cooling motor lubricant (e.g., lubricating oil).

As will be described in more detail below, in order to cool the motor's dielectric lubricant, a supporting frame structure such as the top end assembly of a caisson (FIG. 1) or ESP mounting skid (FIG. 3A) having structural members exposed to environmental seawater, is formed/modified to have fluid conduits within the structural members that establish lubricant pathways for lubricant to flow. A heated/hot lubricant line (single or multiple conduits) connects between a lubricant inlet port in the supporting frame structure and a lubricant outlet port in the motor housing of the ESP. A cooled lubricant line connects between a lubricant outlet port in the supporting frame structure and a lubricant inlet port in the motor housing. A pump/thrust bearing/impeller and/or other fluid moving device generally connected adjacent to or within the motor housing circulates the lubricant from within the motor (motor housing) to the lubricant pathways within the supporting frame structure, whereby the seawater passing over external surfaces of the structural members cools the lubricant contained therein. The cooled lubricant is then circulated back into the motor (motor housing) to assist in cooling the components of the motor located within the housing, particularly those in direct contact with the motor lubricant.

Figure 1:
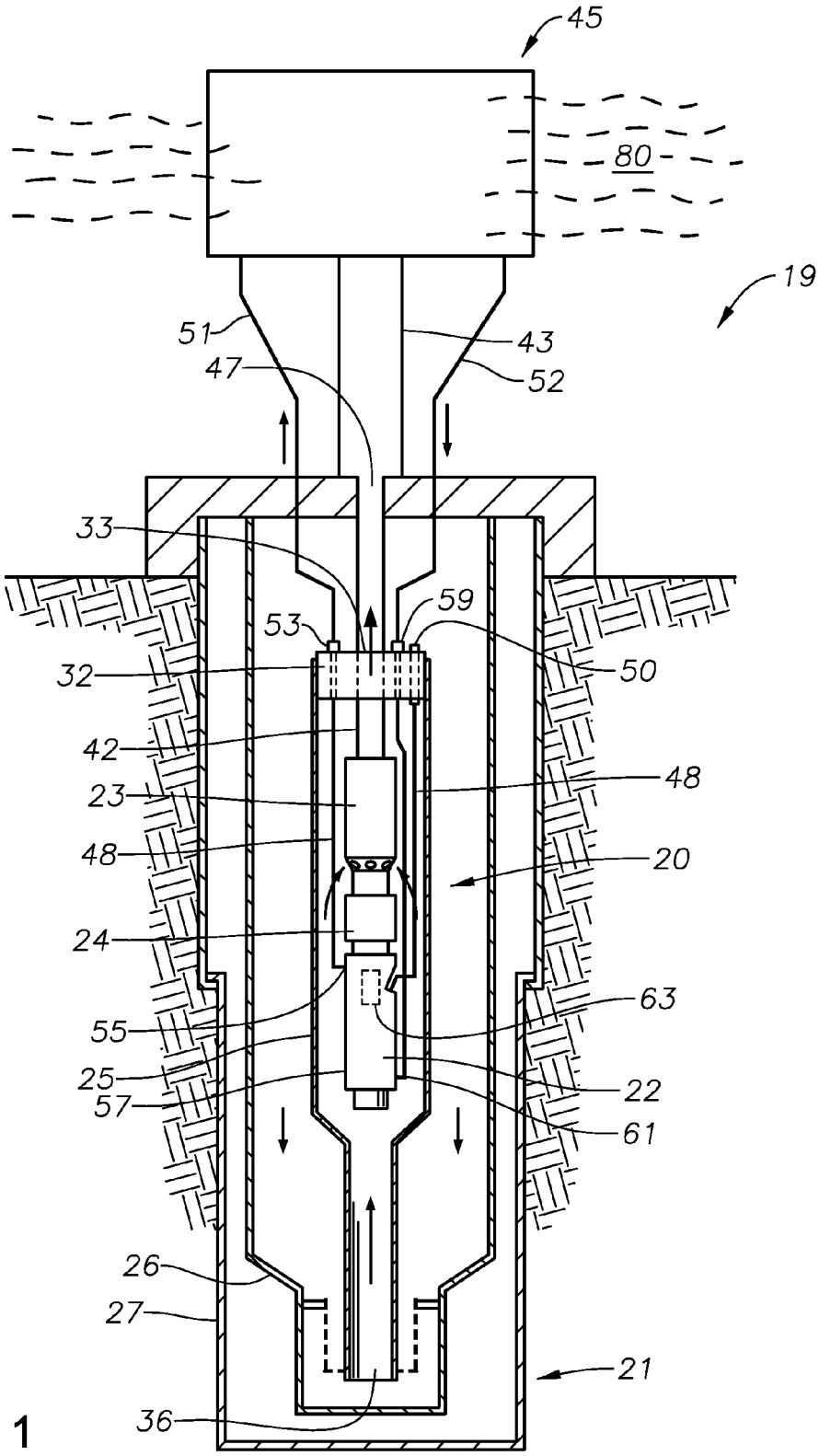
FIG. 1 is a schematic diagram of a system for cooling a motor of an electrical submersible pump (ESP) assembly employed in an electrical submersible subsea booster pumping system according to an embodiment of the present invention.

FIG. 1 illustrates an example of a system 19 to cool the dielectric lubricant used to lubricate a motor 22 of an ESP 20 to thereby cool the motor 22 of the ESP 20. The ESP 20, illustrated in a standard arrangement, can be part of a subsea boosting system located on or adjacent a seabed. Note, the ESP 20 may be horizontally mounted, inclined, or vertically mounted within a caisson 21 in the seafloor according to various configurations. It also may be alternatively positioned in an inverted arrangement depending upon the desired direction of flow of the production fluid. Orientation of the ESP 20 within a caisson 21 and various fluid pathway configurations for production fluid is described in more detail, for example, in U.S. patent application Ser. No. 12/825,141 filed Jun. 28, 2010, titled "Heat Exchanger for ESP Motor."

The caisson 21 can be partially or completely submerged in the seabed and can be several hundred feet deep. The caisson 21 can be used to separate gas in the production fluid to thereby increase pumping efficiency. In such configuration, the well fluid would flow into the top of the caisson, then down to the open bottom end of the capsule, where it would be pumped upward by the ESP 20.

The ESP 20 can include a motor 22 and a pump 23 with a seal section 24 located in between. The seal section 24 typically contains a thrust bearing and a pressure equalizer (not shown) to equalize the pressure of lubricant in the motor 22 with the hydrostatic pressure within the caisson 21.

A containment vessel in the form of a shroud or capsule 25 houses the ESP 20 within the fluid collector 26 positioned within a caisson housing 27. The capsule 25 has a cap or barrier 32 at one end having a discharge port 33 extending therethrough, and an intake port 36 at the other end. The capsule 25 in this example is located on the sea floor and is vertical. The cap 32 can have various types of ports and connections depending on the configuration of the ESP 20 within the capsule 25. In this example, the motor 22 and pump 23 are in the standard position such that the base of the motor 22 faces the intake port 36 end of the capsule 25. Thus, the motor 22 is located below the pump 23 such that the base of the motor 22 is at the end of the capsule 25 opposite the cap 32 and a seal section 24 is located between the motor 22 and pump 23.

The production fluid will flow into the capsule fluid collector 26 and up through the intake port 36 at the lower end of the capsule 25. Production fluid discharge tubing 42 connects to a flow line or riser 43 extending through the discharge port 33 to carry production fluid from a well. That is, in this example, the pump 23 discharges the production fluid through a piece of discharge tubing 42 that passes through the discharge port 33 in the cap 32. The discharge tubing 42 can connect to a flow line or riser 43 extending up through a pumped liquid outlet 47 in the top portion of the housing 27 of the caisson 21 to a top and assembly 45 of the caisson 21.

A power cable 48 runs through an electrical penetrator 50 in the cap 32 and connects to motor 22 to energize it. A hot oil conduit or line 51 extends down through a lubricating oil outlet port 53 in the cap 32 and into the capsule 25 and further extends into an oil outlet port 55 in an upper portion of the motor housing 57 to communicate with the top of the motor 22. A cooled oil line 52 extends down through lubricating oil inlet port 59 in the cap 32 and into the capsule 25 and further extends into an oil inlet port 61 in a bottom portion of the motor housing 57. In this example, the cooled oil line 52 returns the cooled oil from the top end assembly 45 to the base of the motor 22.

Note, one of ordinary skill in the art would recognize that the location of outlet ports 53, 55 and inlet ports 59, 61 are illustrated according to an exemplary configuration and that other locations can be selected. Note also, although hot oil conduit or line 51 and cooled oil conduit or line 52 are each illustrated as a single conduit, one of ordinary skill in the art would understand that the conduits or lines 51, 52 can be continuous, segmented into multiple separate conduits, or a combination thereof.

Figure 2:
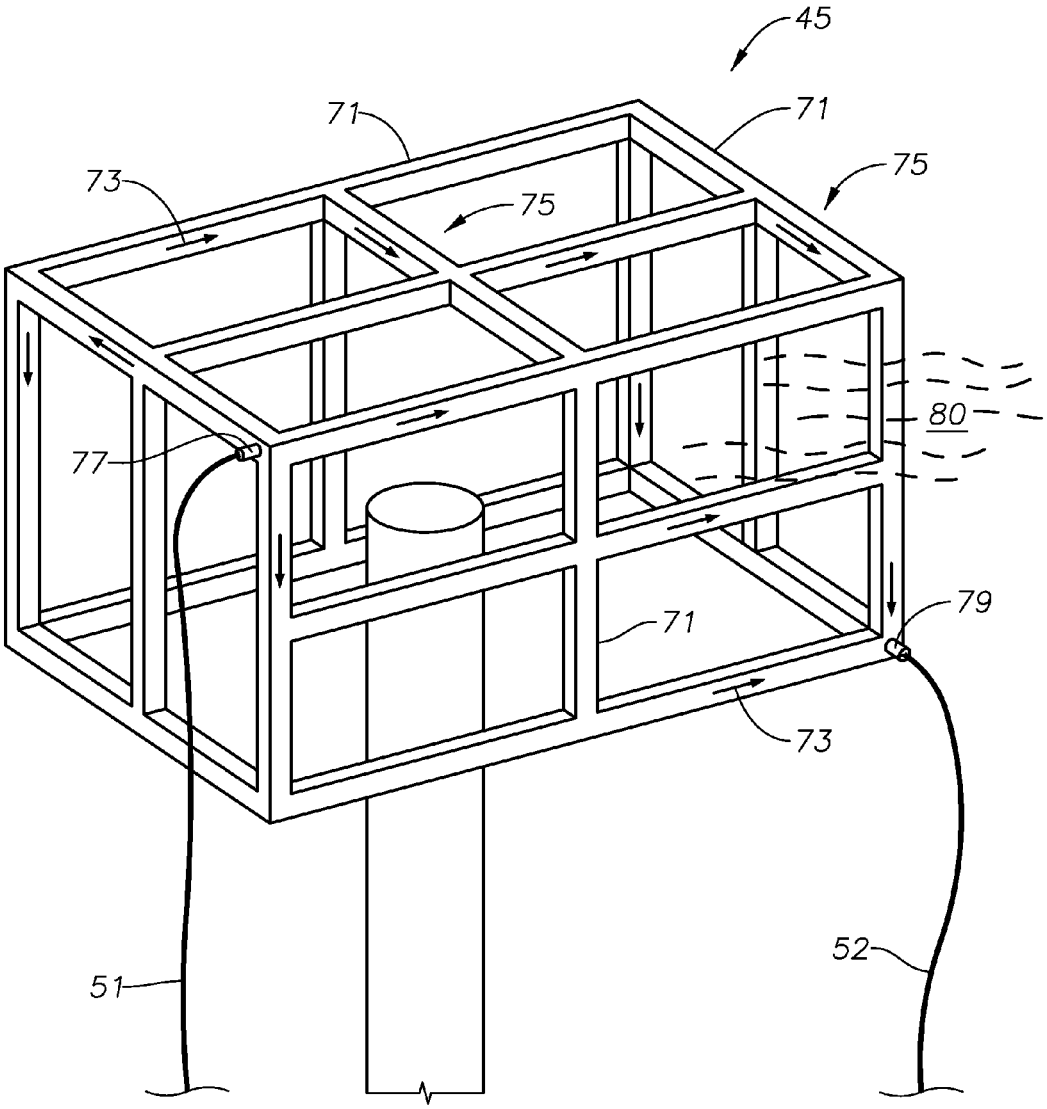
FIG. 2 is a perspective view of a top-end assembly of a caisson illustrating the addition of fluid conduits and resulting fluid flow patterns according to an embodiment of the present invention.

Referring to FIG. 2, the top end assembly 45 can include a plurality of elongate main structural members 71 having an exterior surface substantially exposed to seawater when positioned in a subsea environment. A main body of each of the structural members 71 can be modified to include a fluid conduit 73 formed at least partially therethrough along a longitudinal axis thereof. Thus, in a preferred configuration, the structural members 71 are in the form of tubes. Regardless, the plurality of fluid conduits 73 and corresponding plurality of elongate main structural members 71 can be connected to form a plurality of different dielectric lubricant pathways 75 between a fluid inlet 77 in one of the members 71 connected to the hot oil conduit or line 51 and an outlet 79 in one of the members 71 connected to the cooled oil conduit or line 52.

Referring again to FIG. 1, the ESP 20 can be modified to include or is otherwise provided a throw-out bearing, impeller, oil pump and/or other pumping means (collectively "oil pump") 63 having sufficient pressure to circulate the lubricating oil in the loop formed by the housing 57 of the motor 22, the hot and cooled oil conduit or lines 51, 52, and the fluid pathways 75 formed within the top end assembly 45.

During operation of the ESP 20, the temperature of the motor oil inside the motor 22 and circulating through the seal section 24 rises. Reducing the temperature of the motor oil to thereby cool the motor 22 advantageously extends the life and increases the reliability of the motor 22. Accordingly, employing the top end assembly 45 as a surrogate heat exchanger located externally to the capsule 25 (or on a skid that supports a capsule similar to capsule 25, described later) can be accomplished to cool the motor oil.

Portions of the hot oil line 51 pass through the connector/outlet port 53 that passes through the cap 32 to allow the hot oil line 51 to communicate with the top of the motor 22. The hot oil line 51 allows hot motor oil from the motor 22 to be circulated to the fluid pathways 75 in the top end assembly 45. Once inside the top end assembly 45, the hot oil is circulated through the fluid conduits 73 of the members 71 externally exposed to the seawater 80. A substantial amount of heat absorbed by the oil from within the motor 22 is thus transferred to the seawater 80 and the cooled oil is reintroduced to the motor 22 via the cooled oil line 52. The cooled oil line 52 passes through connector/oil inlet port 59 and through oil inlet port 61 in the housing 57 of the motor 22.

In this example, the oil pump 63 is located inside and at the top end of the motor 22. According to a specific exemplary configuration, the oil pump 63 is driven by a shaft in the motor 22 and circulates the oil in the loop formed by the motor 22, oil conduit or lines 51, 52 and the conduits 73 within the top end unit 45. Further, in this exemplary configuration, due to the overall size of the structural members 71 and the length of the oil conduits or lines 51, 52, the fluid carrying volume of such external components in relation to the volume of the fluid conduits within the motor housing 57 can be on the order of five to ten times greater, or more. Accordingly, according to such exemplary configuration, the motor 22 not only operates at a cooler temperature and can operate longer and more reliably as a result of utilization of a the external surrogate heat exchanger, but also operates at such improved conditions due to the increased volume of lubricating oil available to perform the cooling function and the extended life of the lubricating oil resulting from such utilization of a substantially larger volume than that previously possible.

Figure 3A:
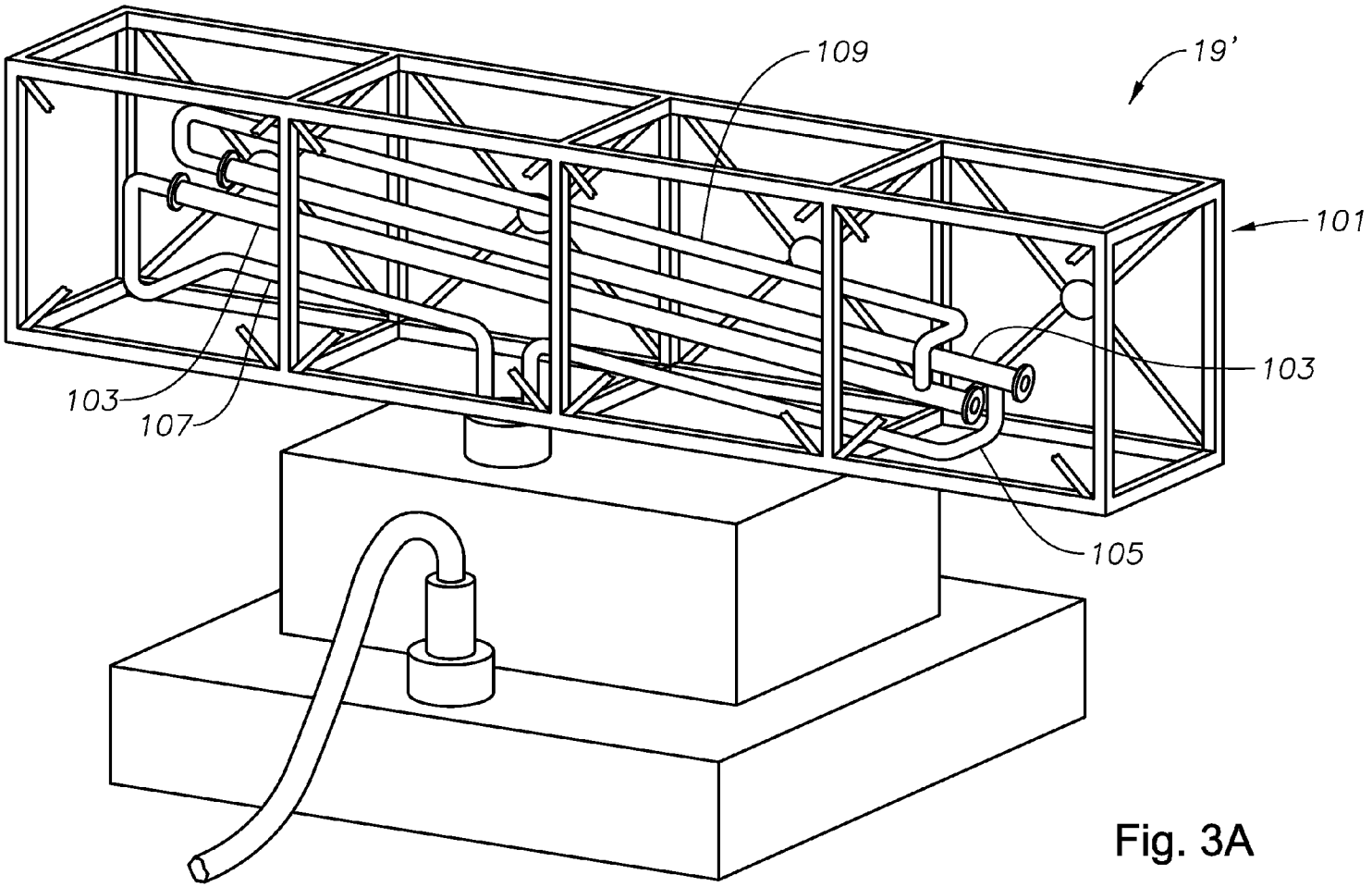
FIGS. 3A-3B are a perspective view of a system for cooling a motor of an ESP assembly employed in an electrical submersible subsea booster pumping system according to an embodiment of the present invention.
Figure 3B:
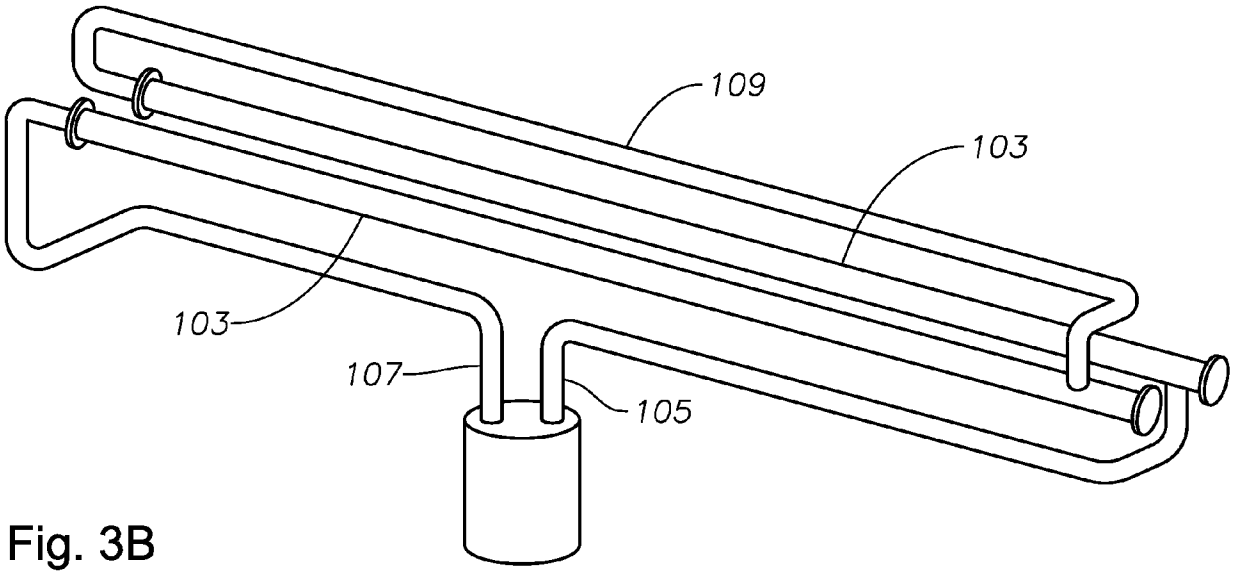
Figure 4:
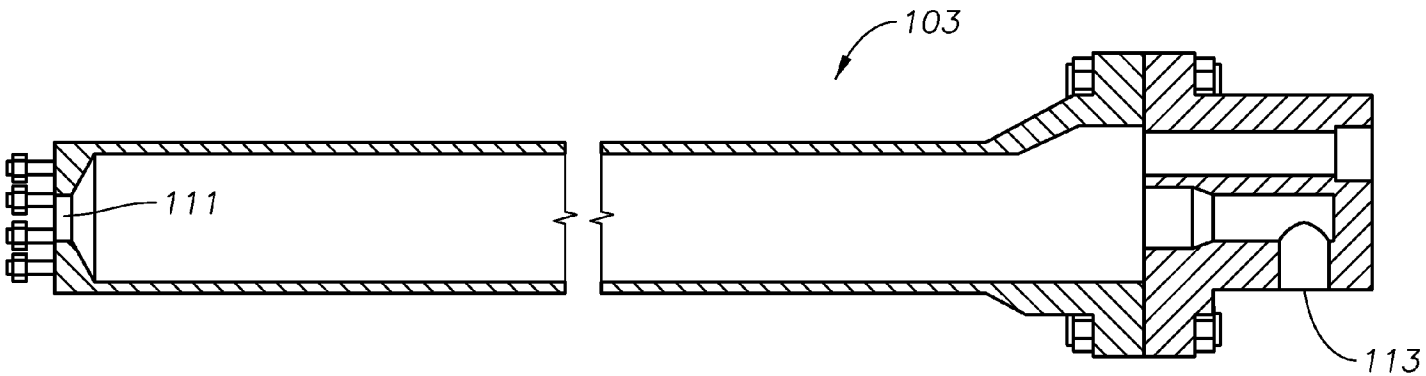
FIG. 4 is a schematic diagram of a capsule for containing an ESP according to the embodiment of the present invention shown in FIG. 3A.

FIGS. 3A and 3B illustrate an alternate embodiment of the present invention whereby the subsea supporting frame structure providing surrogate heat exchanger functionality comprises an ESP mounting skid 101 positioned in a vicinity of the sea floor. FIGS. 3A and 3B further illustrate a pair of capsules 103 (similar to capsule 25) each positioned within the confines of the mounting skid 101 and containing an ESP 20, connected in series to inbound and outbound production flow lines 105, 107, and an intermediate connector line 109. As shown in FIG. 4, according to the illustrated configuration, each of the capsules 103 according to the "paired" configuration can include both an inline production fluid connection port 111 and a radially oriented production fluid connection port 113 facilitates positioning of the pair of capsules 103 within the confines of the mounting skid 101.

Figure 5:
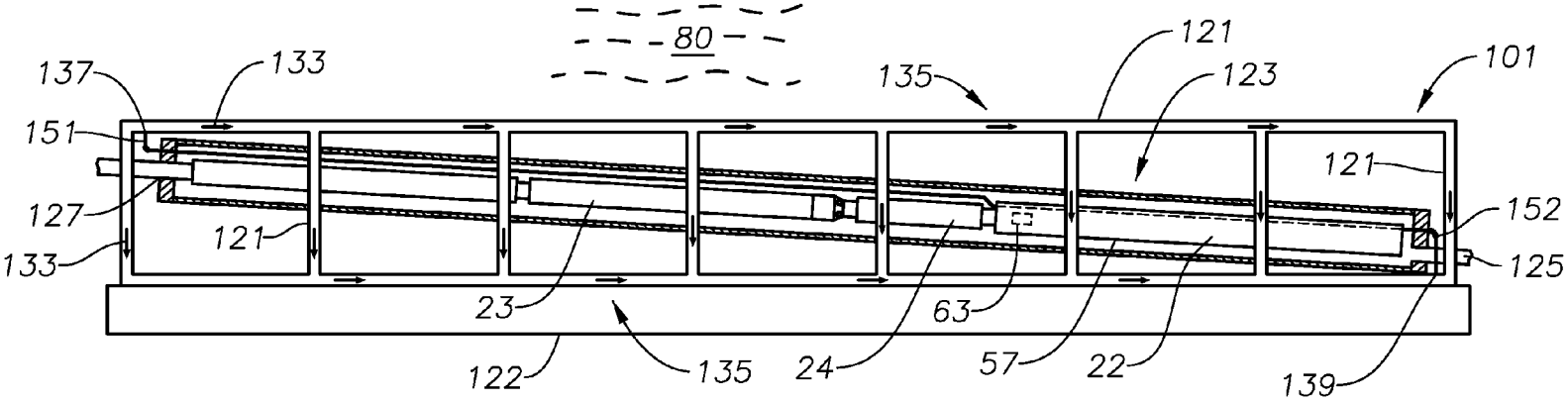
FIG. 5 is a schematic diagram of a system for cooling a motor of an ESP assembly employed in an electrical submersible subsea booster pumping system according to an embodiment of the present invention.
Figure 8:
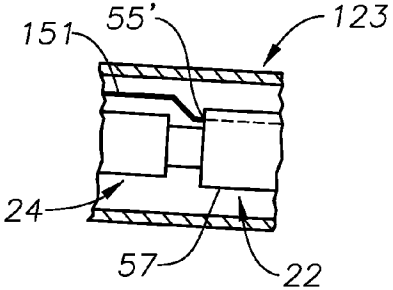
FIG. 8 is a schematic diagram illustrating connection of an external hot oil line to an upper end of an ESP motor according to the embodiment of the present invention shown in FIG. 5.
Figure 7:
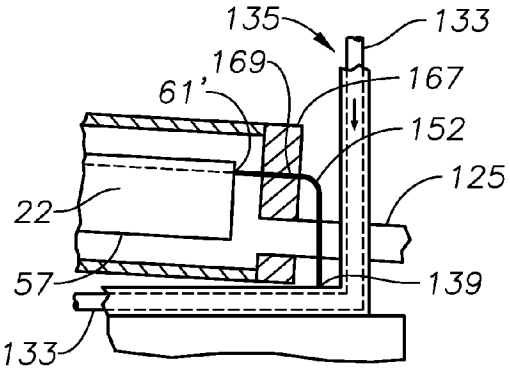
FIG. 7 is a schematic diagram illustrating connections and ports adjacent a lower end of an ESP according to the embodiment of the present invention shown in FIG. 5.
Figure 6:
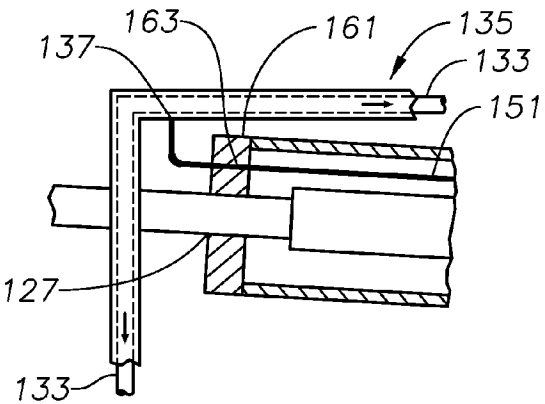
FIG. 6 is a schematic diagram illustrating connections and ports adjacent an upper end of an ESP according to the embodiment of the present invention shown in FIG. 5.

FIG. 5 illustrates a sectional view of the mounting skid 101 having multiple elongate main structural members 121 directly or indirectly connected to a base 122 and framing a single ESP 20 contained in a capsule or other containment vessel 123 having an in-line production fluid inlet/port 125 and a production fluid discharge outlet/port 127. Each of the structural members 121 have an exterior surface substantially exposed to seawater 50.

A main body of each of a set of the structural members 121 are modified to include a fluid conduit 133 formed therethrough along a longitudinal axis thereof. Thus, in a preferred configuration, the structural members 121 provided to include the fluid conduits 133 are in the form of tubes. Regardless, the plurality of fluid conduits 133 and corresponding plurality of elongate main structural members 121 can be connected to form a plurality of different dielectric lubricant pathways 135 between a fluid inlet 137 in one of the members 121 connected to the hot oil conduit or line 151, and an outlet 139 in one of the members 121 connected to the cooled oil conduit or line 152.

Although the accessories connected to ESP 20 shown in FIG. 5 are similar to those shown in FIG. 1, the following differences are noted. As indicated above, connection within mounting skid 101 can typically result in much smaller hot and cooler oil conduits or lines 151, 152 than the hot and cooler oil conduits or lines 51, 52. Additionally, according to the horizontal layout shown in FIG. 5, the capsule 123 includes an end cap 161 having outlet port 163 that accommodates hot oil conduit or line 151 along with production outlet/port 127, and includes an end cap 167 having inlet port 169 that accommodates cooler oil conduit or line 152 along with production inlet/port 125.

As further shown in FIGS. 5-8, in an embodiment utilizing a single hot oil conduit or line 151 and a single cooler oil conduit or line 152, the hot oil conduit or line 151 extends down from inlet 137 through a lubricating oil outlet port 163 in the end cap 161 and into the capsule 123 and further extends into the oil outlet port 55' in an upper portion of the motor housing 57 to communicate with the top of the motor 22. The cooled oil line 152 extends up from outlet 139, through lubricating oil inlet port 169 in the end cap 167 and into the capsule 123 and further extends into an oil inlet port 61' in a bottom portion of the motor housing 57. In this example, the cooled oil line 152 returns the cooled oil from the lower end of mounting skid 101 to the base of the motor 22.

Note, one of ordinary skill in the art would recognize that the location of outlet ports 55', 139, 163 and inlet ports 61', 137, 169 are illustrated according to an exemplary configuration and that other locations can be selected. Note also, although hot oil conduit or line 151 and cooled oil conduit or line 152 are each illustrated as a single conduit, one of ordinary skill in the art would understand that the conduits or lines 151, 152 can be continuous, segmented into multiple separate conduits, or a combination thereof.

As in the previously described embodiment of the present invention, the ESP 20 shown in FIG. 5 is modified to include or is otherwise provided various pumping means (collectively "oil pump" 63) having sufficient pressure to circulate the lubricating oil in the loop formed by the housing 57 of the motor 22, the hot and cooled oil conduit or lines labeled 151, 152 in FIGS. 5-8, and the fluid pathways 135 formed within the mounting skid 101.

During operation of the ESP 20, the temperature of the motor oil inside the motor 22 and circulating through the seal section 24 rises. In order to reduce the temperature of the motor oil to thereby cool the motor 22, the mounting skid 101 modified to include passageways 135 can be employed as a surrogate heat exchanger to cool the motor oil. Portions of the hot oil line 151 passes through the connector/outlet port 163 that passes thru the end cap 127 to allow the hot oil line 151 to communicate with the top of the motor 22. The hot oil line 151 allows hot motor oil from the motor 22 to be circulated to the fluid pathways 135 in the established in the mounting skid 101. Once inside the mounting skid 101, the hot oil is circulated through the fluid conduits 133 of the members 121 externally exposed to the seawater 80. A substantial amount of heat absorbed by the oil from within the motor 22 is thus transferred to the seawater 80 and the cooled oil is reintroduced to the motor 22 via the cooled oil line 152. The cooled oil line 152 passes thru connector/oil inlet port 169 and through oil inlet port 61' in the housing 57 of the motor 22.

As in the prior described embodiment of the present invention, in this example, an oil pump or the other pumping means 63 is located inside and at the top end of the motor 22. According to a specific exemplary configuration, the oil pump 63 is driven by a shaft in the motor 22 and circulates the oil in the loop formed by the motor 22, oil conduit or lines 151, 152 and the conduits 133 within the mounting skid 101. Further, in this exemplary configuration, due to the overall size of the structural members 121, the fluid carrying volume of such external components in relation to the volume of the fluid conduits within the motor housing 57 can be on the order of five to ten times greater, or more. Accordingly, according to such exemplary configuration, the motor 22 not only operates at a cooler temperature and can operate longer and more reliably as a result of utilization of a the external surrogate heat exchanger, but also operates at such improved conditions due to the increased volume of lubricating oil available to perform the cooling function and the extended life of the lubricating oil resulting from such utilization of a substantially larger volume than that previously possible.

Various embodiments of the present invention includes several advantages. Various embodiments of the present invention provide system components and process steps to circulate motor lubricating fluid/oil for a deployed ESP through the frame of a skid or caisson head. While the lubricating fluid/oil travels through the frame, the motor lubricating fluid/oil is cool down by the sea water around the frame. The cooled lubricating fluid/oil is then used to cool components of the motor located within the motor housing—reducing overall motor temperature and correspondingly increasing the life of the equipment. According to an exemplary configuration, utilization of the frame of the mounting skid or casing head is accomplished by manufacturing multiple structural and/or nonstructural members of the respective frame, generally in tubular form (e.g., hollow along substantial portions of the length of the member), using materials having a high thermal conductivity. Advantageously, utilization of a modified version of an existing frame, rather than employing an entirely system heat exchange component, can reduce capital costs, need for additional real estate, etc., and, due to the size of the frame, can provide a large seawater contact surface area and a cooling lubricant volume capability (e.g., 5-10 times fluid capacity) beyond that previously thought of, and thus, a cooling capability beyond that previously possible.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

That claimed is:

1. A method of cooling a motor of an electrical submersible pump assembly employed in an electrical submersible subsea booster pumping system, the method comprising the steps of:

filling the motor of the electrical submersible pump assembly with a dielectric lubricant and providing the motor with a motor dielectric lubricant inlet port and a motor dielectric lubricant outlet port spaced from the motor dielectric lubricant inlet port;

circulating the dielectric lubricant from the motor dielectric lubricant outlet port to an inlet port of at least one of a plurality of elongate main structural members of a subsea supporting frame structure;

circulating the dielectric lubricant through the plurality of elongate main structural members, where each of the plurality of elongate main structural members includes a fluid conduit formed at least partially therethrough along a longitudinal axis thereof and each fluid conduit is in fluid communication with the fluid conduit of at least one other member of the plurality of elongate main structural members in the subsea supporting frame structure;

removing heat energy from the dielectric lubricant circulating through the plurality of elongate main structural members by transferring the heat energy in the dielectric lubricant to seawater flowing through the subsea supporting frame structure and across outer surfaces of the plurality of elongate main structural members to thereby reduce the temperature of the dielectric lubricant; and circulating the dielectric lubricant from an outlet port of the at least one of the plurality of elongate main structural members of the subsea supporting frame structure to the motor dielectric lubricant inlet port.

2. A method as defined in claim 1, wherein the subsea supporting frame structure comprises an electrical submersible pump mounting skid positioned in a vicinity of a sea floor;

wherein the method further comprises the step of positioning at least major portions of the electrical submersible pump assembly within the confines of the electrical submersible pump mounting skid, the at least major portions of the electrical submersible pump assembly including the subsea electrical submersible pump motor; and wherein the step of circulating the dielectric lubricant through the plurality of elongate main structural members includes the step of circulating the dielectric lubricant through a corresponding plurality of main structural members of the electrical submersible pump mounting skid.

3. A method as defined in claim 2, wherein the subsea electrical submersible pump motor is positioned within a containment vessel;

the containment vessel having a dielectric lubricant outlet port and a dielectric lubricant inlet port, wherein the electrical submersible pump assembly further includes a first conduit segment, a second conduit segment, a third conduit segment, a fourth conduit segment, and a fluid moving device, and wherein the method further comprises the steps of:

connecting the first conduit segment between the motor dielectric lubricant outlet port and the dielectric lubricant outlet port in the containment vessel to circulate the dielectric lubricant through the first conduit segment;

connecting the second conduit segment between the dielectric lubricant outlet port in the containment vessel and the inlet port of the at least one of the plurality of elongate main structural members of the electrical submersible pump mounting skid;

connecting the third conduit segment between the dielectric lubricant inlet port in the containment vessel and the motor dielectric lubricant inlet port to circulate the dielectric lubricant through the third conduit segment;

connecting the fourth conduit segment between the outlet port of the at least one the of plurality of elongate main structural members and the dielectric lubricant inlet port in the containment vessel;

and positioning the fluid moving device within the motor to provide motivation to circulate the dielectric lubricant.

4. A method as defined in claim 2, further comprising the step of:

connecting the plurality of elongate main structural members of the electrical submersible pump mounting skid to form a plurality of interconnected fluid pathways through the elongate main structural members of the electrical submersible pump mounting skid; and wherein the step of circulating the dielectric lubricant through the plurality of elongate main structural members includes circulating respective portions of the dielectric lubricant through each separate one of the plurality of fluid pathways within the electrical submersible pump mounting skid.

5. A method as defined in claim 2, wherein a total quantity of the dielectric lubricant circulated within the plurality of conduits in the main structural members of the electrical submersible pump mounting skid and dielectric lubricant circulation components within confines of the motor exceed a quantity of the dielectric lubricant in the dielectric lubricant circulation components within the confines of the motor by at least a factor of three to thereby enhance the cooling of the motor.

6. A method as defined in claim 1, wherein the subsea supporting frame structure comprises a top end assembly of a subsea caisson positioned in a vicinity of a sea floor;

wherein the method further comprises the step of positioning at least major portions of the electrical submersible pump assembly within the confines of the subsea caisson, the at least major portions of the electrical submersible pump assembly including the subsea electrical submersible pump motor; and wherein the step of circulating the dielectric lubricant through the plurality of elongate main structural members of the subsea supporting frame structure includes the step of circulating the dielectric lubricant through main structural members of the top end assembly of the subsea caisson.

7. A method as defined in claim 6, wherein the subsea electrical submersible pump motor is housed within a containment vessel;

the containment vessel having a dielectric lubricant outlet port and a dielectric lubricant inlet port, wherein the electrical submersible pump assembly further includes a first conduit segment, a second conduit segment, a third conduit segment, a fourth conduit segment, and a fluid moving device, and wherein the method further comprises the steps of:

connecting the first conduit segment between the motor dielectric lubricant outlet port and the dielectric lubricant outlet port in the containment vessel to circulate the dielectric lubricant through the first conduit segment;

connecting the second conduit segment between the dielectric lubricant outlet port in the containment vessel and the inlet port of at least one of the plurality of elongate main structural members of the top end assembly of the subsea caisson;

connecting the third conduit segment between the outlet port of at least one of the plurality of elongate main structural members of the top end assembly and the dielectric lubricant inlet port in the containment vessel;

connecting the fourth conduit segment between the dielectric lubricant inlet port in the containment vessel and the motor dielectric lubricant inlet port to circulate the dielectric lubricant through the fourth conduit segment; and positioning the fluid moving device within the motor to provide motivation to circulate the dielectric lubricant.

8. A method as defined in claim 6, further comprising the step of:

connecting the plurality of elongate main structural members of the top end assembly of the subsea caisson to form a plurality of interconnected fluid pathways through the elongate main structural members of the top end assembly of the subsea caisson; and wherein the step of circulating the dielectric lubricant through the plurality of elongate main structural members includes circulating respective portions of the dielectric lubricant through each separate one of the plurality of fluid pathways within the top end assembly of the subsea caisson.

9. A method as defined in claim 6, wherein a total quantity of the dielectric lubricant circulated within the plurality of elongate main structural members of the top end assembly of the subsea caisson and dielectric lubricant circulation components within confines of the motor exceed a quantity of the dielectric lubricant in the dielectric lubricant circulation components within the confines of the motor by at least a factor of three to thereby enhance the cooling of the motor.

10. A method of cooling a motor of an electrical submersible pump employed in an electrical submersible subsea booster pumping system, the method comprising the steps of:

providing an electrical submersible pump assembly in a vicinity of a sea floor, the electrical submersible pump assembly including a motor and at least one pump housed within a containment vessel, the motor being filled with a dielectric lubricant and having a motor dielectric lubricant inlet port and a motor dielectric lubricant outlet port spaced apart from the motor dielectric lubricant inlet port, the containment vessel also having a dielectric lubricant inlet port and a dielectric lubricant outlet port, the electrical submersible pump assembly further including a first conduit segment extending between the motor dielectric lubricant outlet port and the dielectric lubricant outlet port in the containment vessel and a second conduit segment extending between the dielectric lubricant inlet port in the containment vessel and the motor dielectric lubricant inlet port;

providing a subsea supporting frame structure adjacent the electrical submersible pump assembly, the subsea supporting frame structure comprising a mounting skid framing at least major portions of the electrical submersible pump assembly and comprising a plurality of elongate main structural members, each of the plurality of elongate main structural members having a fluid conduit extending along a longitudinal axis thereof and interconnected so that the fluid conduits collectively form a manifold structure, at least one of the plurality of elongate main structural members including a fluid inlet port in fluid communication with the dielectric lubricant outlet port in the containment vessel of the electrical submersible pump assembly defining a supporting frame structure fluid inlet, at least one of the plurality of elongate main structural members including a fluid outlet port in fluid communication with the dielectric lubricant inlet port in the containment vessel of the electrical submersible pump assembly defining a supporting frame structure fluid outlet, portions of the dielectric lubricant flowing along a plurality of different pathways between the fluid inlet and the fluid outlet of the supporting frame structure formed by the plurality of elongate main structural members;

circulating dielectric lubricant from the motor dielectric lubricant outlet port to the fluid inlet of the supporting frame structure;

removing heat from the dielectric lubricant circulating through the plurality of elongate main structural members flowing through the plurality of different pathways between the fluid inlet and the fluid outlet of the supporting frame structure, by transferring heat energy in the dielectric lubricant to seawater flowing through the subsea supporting frame structure and across outer surfaces of the plurality of elongate main structural members to thereby reduce the temperature of the dielectric lubricant; and circulating the dielectric lubricant from the outlet port of the supporting frame structure to the motor dielectric lubricant inlet port.

11. A system for cooling a motor of an electrical submersible pump assembly employed in an electrical submersible subsea booster pumping system, the system comprising:

an electrical submersible pump assembly including a subsea electrical submersible pump having a motor filled with dielectric lubricant, a motor dielectric lubricant outlet port, and a motor dielectric lubricant inlet port, the motor dielectric lubricant outlet port spaced apart from the motor dielectric lubricant inlet port;

a subsea supporting frame structure having a plurality of elongate main structural members, each of the plurality of elongate main structural members having an exterior surface substantially exposed to seawater in a subsea environment and having a main body having a fluid conduit formed at least partially therethrough along a longitudinal axis thereof, the plurality of fluid conduits and corresponding plurality of elongate main structural members connected to form a plurality of different dielectric lubricant pathways between a supporting frame structure fluid inlet and a supporting frame structure fluid outlet;

at least one fluid conduit extending from the motor dielectric lubricant outlet port to the supporting frame structure fluid inlet to thereby form a heated dielectric lubricant discharge pathway therebetween;

at least one other fluid conduit extending from the supporting frame structure fluid outlet to the motor dielectric lubricant inlet port to thereby form a cooled dielectric lubricant return pathway therebetween;

a fluid moving device positioned to circulate the dielectric lubricant from the motor through the heated dielectric lubricant discharge pathway, the plurality of different dielectric lubricant pathways through the supporting frame structure, and the cooled dielectric lubricant return pathway; and wherein the electrical submersible subsea booster pumping system is deployed such that the dielectric lubricant that circulates through the supporting frame structure is cooled by the surrounding seawater.

12. A system as defined in claim 11, wherein the subsea supporting frame structure comprises an electrical submersible pump mounting skid positioned in a vicinity of a sea floor; and wherein at least major portions of the electrical submersible pump assembly are positioned within the confines of the mounting skid, the at least major portions of the subsea electrical pump assembly including the subsea electrical submersible pump motor.

13. A system as defined in claim 12, wherein at least one of the plurality of elongate main structural members includes a fluid inlet port defining the supporting frame structure fluid inlet;

wherein at least one of the plurality of elongate main structural members includes a fluid outlet port defining the supporting frame structure fluid outlet; and wherein the plurality of different dielectric lubricant pathways are configured to collectively form a manifold structure to facilitate a transfer of heat energy in dielectric lubricant circulating through the plurality of different dielectric lubricant pathways to seawater flowing through the subsea supporting frame structure and across outer surfaces of the plurality of elongate main structural members to thereby reduce temperature of the dielectric lubricant.

14. A system as defined in claim 12, further comprising:

a containment vessel having a dielectric lubricant outlet port and a dielectric lubricant inlet port, and positioned to contain at least major portions of the electrical submersible pump assembly;

wherein the at least one fluid conduit extending between the motor dielectric lubricant outlet port and the supporting frame structure fluid inlet includes a first conduit segment connected between the motor dielectric lubricant outlet port and the containment vessel dielectric lubricant outlet port and a second conduit segment connected between the containment vessel dielectric lubricant outlet port and the supporting frame structure fluid inlet; and wherein the at least one fluid conduit extending between the supporting frame structure fluid outlet and the motor dielectric lubricant inlet port includes a third conduit segment connected between the supporting frame structure fluid outlet and the containment vessel dielectric lubricant inlet port and a fourth conduit segment connected between the containment vessel dielectric lubricant inlet port and the motor dielectric lubricant inlet port.

15. A system as defined in claim 12, wherein a total quantity of the dielectric lubricant circulated within the fluid conduits in the elongate main structural members of the electrical submersible pump mounting skid and dielectric lubricant circulation components within confines of the motor exceed a quantity of the dielectric lubricant in the dielectric lubricant circulation components contained within the confines of the motor by at least a factor of at least four to thereby enhance the cooling of the motor.

16. A system as defined in claim 11, wherein the subsea supporting frame structure comprises a top end assembly of a subsea caisson positioned in a vicinity of a sea floor; and wherein at least major portions of the electrical submersible pump assembly are positioned within the confines of the subsea caisson, the at least major portions of the electrical submersible pump assembly including the subsea electrical submersible pump motor.

17. A system as defined in claim 16, wherein at least one of the plurality of elongate main structural members includes a fluid inlet port defining the supporting frame structure fluid inlet;

wherein at least one of the plurality of elongate main structural members includes a fluid outlet port defining the supporting frame structure fluid outlet; and wherein the plurality of different dielectric lubricant pathways are configured to collectively form a manifold structure to facilitate a transfer of heat energy in dielectric lubricant circulating through the plurality of different dielectric lubricant pathways to seawater flowing through the subsea supporting frame structure and across outer surfaces of the plurality of elongate main structural members to thereby reduce temperature of the dielectric lubricant.

18. A system as defined in claim 16, further comprising:

a containment vessel having a dielectric lubricant outlet port and a dielectric lubricant inlet port, and positioned to contain at least major portions of the electrical submersible pump assembly;

wherein the at least one fluid conduit extending between the motor dielectric lubricant outlet port and the supporting frame structure fluid inlet includes a first conduit segment connected between the motor dielectric lubricant outlet port and the containment vessel dielectric lubricant outlet port and a second conduit segment connected between the containment vessel dielectric lubricant outlet port and the supporting frame structure fluid inlet; and wherein the at least one fluid conduit extending between the supporting frame structure fluid outlet and the motor dielectric lubricant inlet port includes a third conduit segment connected between the supporting frame structure fluid outlet and the containment vessel dielectric lubricant inlet port and a fourth conduit segment connected between the containment vessel dielectric lubricant inlet port and the motor dielectric lubricant inlet port.

19. A system as defined in claim 16, wherein a total quantity of the dielectric lubricant circulated within the fluid conduits in the elongate main structural members of the top end assembly of the subsea caisson and dielectric lubricant circulation components within confines of the motor exceed a quantity of the dielectric lubricant in the dielectric lubricant circulation components contained within the confines of the motor by at least a factor of at least four to thereby enhance the cooling of the motor.

20. A system for cooling a motor of an electrical submersible pump assembly employed in an electrical submersible subsea booster pumping system, the system comprising:

an electrical submersible pump assembly including a subsea electrical submersible pump having a motor filled with dielectric lubricant, a motor dielectric lubricant outlet port, and a motor dielectric lubricant inlet port, the motor dielectric lubricant outlet port spaced apart from the motor dielectric lubricant inlet port;

a containment vessel positioned to contain at least major portions of the electrical submersible pump assembly and having a dielectric lubricant outlet port and a dielectric lubricant inlet port;

a subsea supporting frame structure having a plurality of elongate main structural members, each of the plurality of elongate main structural members having an exterior surface substantially exposed to seawater in a subsea environment and having a main body having a fluid conduit formed at least partially therethrough along a longitudinal axis thereof, each fluid conduit positioned in fluid communication with at least one other of a plurality of fluid conduits corresponding to the plurality of elongate main structural members, at least one of the plurality of elongate main structural members including a fluid inlet port in fluid communication with the dielectric lubricant outlet port in the containment vessel of the electrical submersible pump assembly defining a supporting frame structure fluid inlet, at least one of the plurality of elongate main structural members including a fluid outlet port in fluid communication with the dielectric lubricant inlet port in the containment vessel of the electrical submersible pump assembly defining a supporting frame structure fluid outlet, a plurality of different dielectric lubricant pathways extending between the fluid inlet and the fluid outlet of the supporting frame structure and through a corresponding different set of one or more of the plurality of fluid conduits, the plurality of different dielectric lubricant pathways configured to facilitate a transfer of heat energy in dielectric lubricant circulating through the plurality of different dielectric lubricant pathways to seawater flowing through the subsea supporting frame structure and across outer surfaces of the plurality of elongate main structural members to thereby reduce temperature of the dielectric lubricant;

at least one fluid conduit extending between the motor dielectric lubricant outlet port and the supporting frame structure fluid inlet to thereby form a heated dielectric lubricant discharge pathway therebetween;

at least one fluid conduit extending between the supporting frame structure fluid outlet and the motor dielectric lubricant inlet port to thereby form a cooled dielectric lubricant return pathway therebetween; and a fluid moving device positioned to circulate dielectric lubricant for the motor through the heated dielectric lubricant discharge pathway, the plurality of different dielectric lubricant pathways through the supporting frame structure to be cooled by seawater when deployed therein, and the cooled dielectric lubricant return pathway.

* * * * *

UNITED STATES PATENT AND TRADEMARK OFFICE

CERTIFICATE OF CORRECTION

PATENT NO. : 8,708,675 B2
APPLICATION NO. : 13/163395
DATED : April 29, 2014
INVENTOR(S) : Ignacio Martinez et al.

It is certified that error appears in the above-identified patent and that said Letters Patent is hereby corrected as shown below:

In the Specification
Column 2, line 30, delete “structures” and insert --structure--
Column 7, line 64, delete “are” and insert --is-- before “modified”

In the Claims
Column 10, line 30, delete “the” and insert --an-- before “electrical”

Signed and Sealed this
Thirteenth Day of January, 2015

Michelle K. Lee

Michelle K. Lee
*Deputy Director of the United States Patent and Trademark Office*